US008661631B2

(12) United States Patent
Palea

(10) Patent No.: US 8,661,631 B2
(45) Date of Patent: Mar. 4, 2014

(54) SHOELACE HOLDER

(76) Inventor: Lance T. Palea, Jacksonville, FL (US)

( * ) Notice: Subject to any disclaimer, the term of this patent is extended or adjusted under 35 U.S.C. 154(b) by 0 days.

(21) Appl. No.: 11/209,173

(22) Filed: Aug. 22, 2005

(65) Prior Publication Data

US 2007/0039145 A1 Feb. 22, 2007

(51) Int. Cl.
*A43C 7/00* (2006.01)

(52) U.S. Cl.
USPC ..... 24/712.1; 24/713; 24/304; 24/306; 36/50.1

(58) Field of Classification Search
USPC ..... 24/712, 712.1, 712.2, 712.4, 713, 304, 24/306; 36/50.1, 50.5
See application file for complete search history.

(56) References Cited

U.S. PATENT DOCUMENTS

| | | | | | |
|---|---|---|---|---|---|
| 4,780,936 | A * | 11/1988 | Brecher | 24/712.2 |
| 4,999,888 | A * | 3/1991 | Miller | 24/712.3 |
| 5,042,119 | A * | 8/1991 | Williams | 24/712.3 |
| 5,349,764 | A * | 9/1994 | Posner | 36/54 |
| 5,701,688 | A * | 12/1997 | Crowley | 36/72 R |
| 5,778,500 | A * | 7/1998 | Illingworth | 24/712.3 |
| 6,000,111 | A * | 12/1999 | Deskins et al. | 24/712.3 |
| 6,941,683 | B2 * | 9/2005 | Freed | 24/712.1 |
| D518,628 | S * | 4/2006 | Hatakeyama | D2/946 |
| D541,515 | S * | 5/2007 | Lane, III | D2/969 |
| 2004/0244162 | A1 * | 12/2004 | Schneider | 24/712.3 |

* cited by examiner

*Primary Examiner* — Robert J Sandy

(57) ABSTRACT

A shoelace holder that includes one or more patches of hook material that either is built into the upper portion of a shoe or releasably attaches to the upper portion of a shoe. The securing device provides function as well as decoration to the shoe surface. The securing device holds the shoelace against the shoe body thereby preventing a tripping hazard whether the shoelace is tied or not.

3 Claims, 5 Drawing Sheets

SHOELACE HOLDER

BACKGROUND OF THE INVENTION

1. Field of the Invention

The present invention relates to devices for securing ties such as cords, strings and laces and particularly knots of tied shoelaces of a shoe, and more particularly relates to an improved apparatus for holding shoelaces of a shoe in a position so that the knot (including the familiar bow-type tie) in such shoelaces does not become loose or untied even after vigorous activity such as running, jumping, sports and the like.

2. Background of the Prior Art

Flexible laces are typically used to securely fasten shoes, sneakers and other footwear. After the lace is tightened on the footwear, the ends are usually tied in a conventional bowknot. It is well known that such bowknots have a tendency to loosen or become untied, which is inconvenient and often hazardous, particularly when one is engaged in athletic activities.

Many children become injured each year when they fall, as by tripping on untied shoelaces or because they tangle their untied shoelaces in objects that are near them. This problem is particularly acute with young toddlers that have trouble tying their own shoelaces.

Furthermore, children will frequently tug or trip on the ends of the laces, thereby loosening or untying the bowknot. This places a burden on parents and other adults charged with supervision of children to continually retie the shoelaces. To overcome this problem, a parent will often tie a double knot to make it more difficult for the child to loosen or untie the knot by pulling on the ends of the laces. This double knot is difficult to untie, even for an adult, when the adult wishes to remove the child's shoes Several patents have been issued for constructions that attempt to solve the problem of shoelaces that become untied during use. For example, U.S. Pat. No. 6,003,214 to Lee describes a shoelace binder that holds the laces in a secure arrangement, yet takes the place of a traditional bowknot.

U.S. Pat. No. 5,913,483 to Polk, U.S. Pat. No. 4,949,437 to Anderson, U.S. Pat. No. 4,291,439 to Riti, U.S. Pat. No. 4,571,854 to Edens, and U.S. Pat. No. 4,879,787 to Walls describe shoe lace securing devices that are attached to the shoe strings and cover the bow knot to hold it in place and prevent it from untying.

U.S. Pat. No. 4,999,888 to Miller describes a retainer device to enclose the shoelaces after they have been tied such that no loose ends remain exposed.

While the prior art may be effective to keep a shoelace knotted and prevent it from becoming loose, it also requires an extra, free standing device to be attached to the laces. None of the prior art discloses a shoelace securing device that is built into the shoe itself.

SUMMARY OF THE INVENTION

A principal concept of the present invention is to provide a securing device that is part of the shoe construction and that prevents the shoelaces from coming untied. The securing device will make use of the hook portion of a typical hook-and-loop fastener.

It is, therefore, an object of the present invention to provide a shoelace securing device that avoids the disadvantages of the prior art.

Another object of the present invention is to provide a shoelace-securing device that can be integrated into the surface of the upper portion of a shoe. A related object of the present invention is to provide a shoelace-securing device that can be attached to the surface of the upper portion of a shoe.

This invention enables a shoelace-securing device that includes one or more patches of hook material that either is built into the upper portion of a shoe or releasably attaches to the upper portion of a shoe. The securing device provides function as well as decoration to the shoe surface. The securing device holds the shoelace against the shoe body thereby preventing a tripping hazard whether the shoelace is tied or not.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference symbols are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
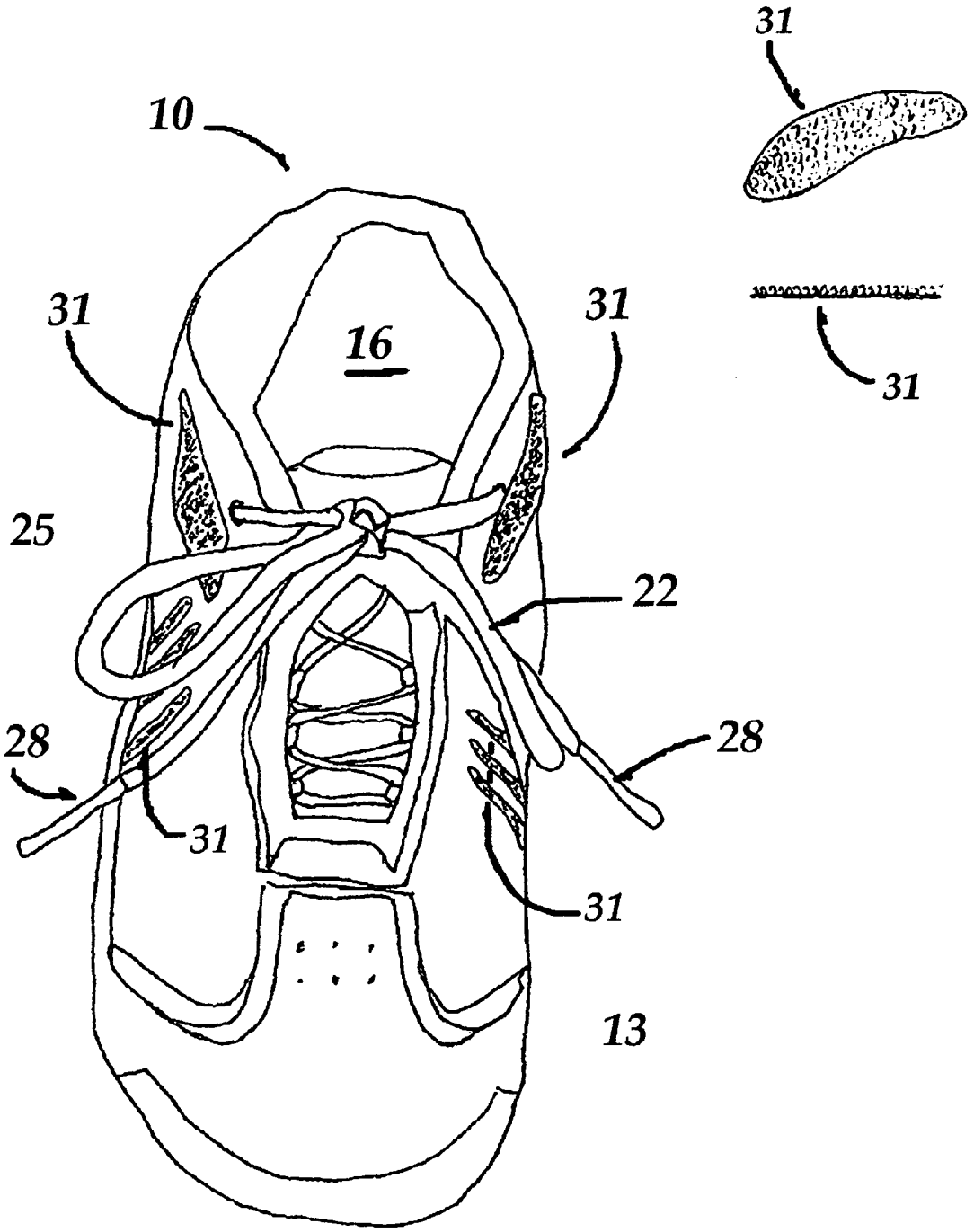
FIG. 1 is a top view of a shoe having the retaining device according to the present invention.
Figure 2:
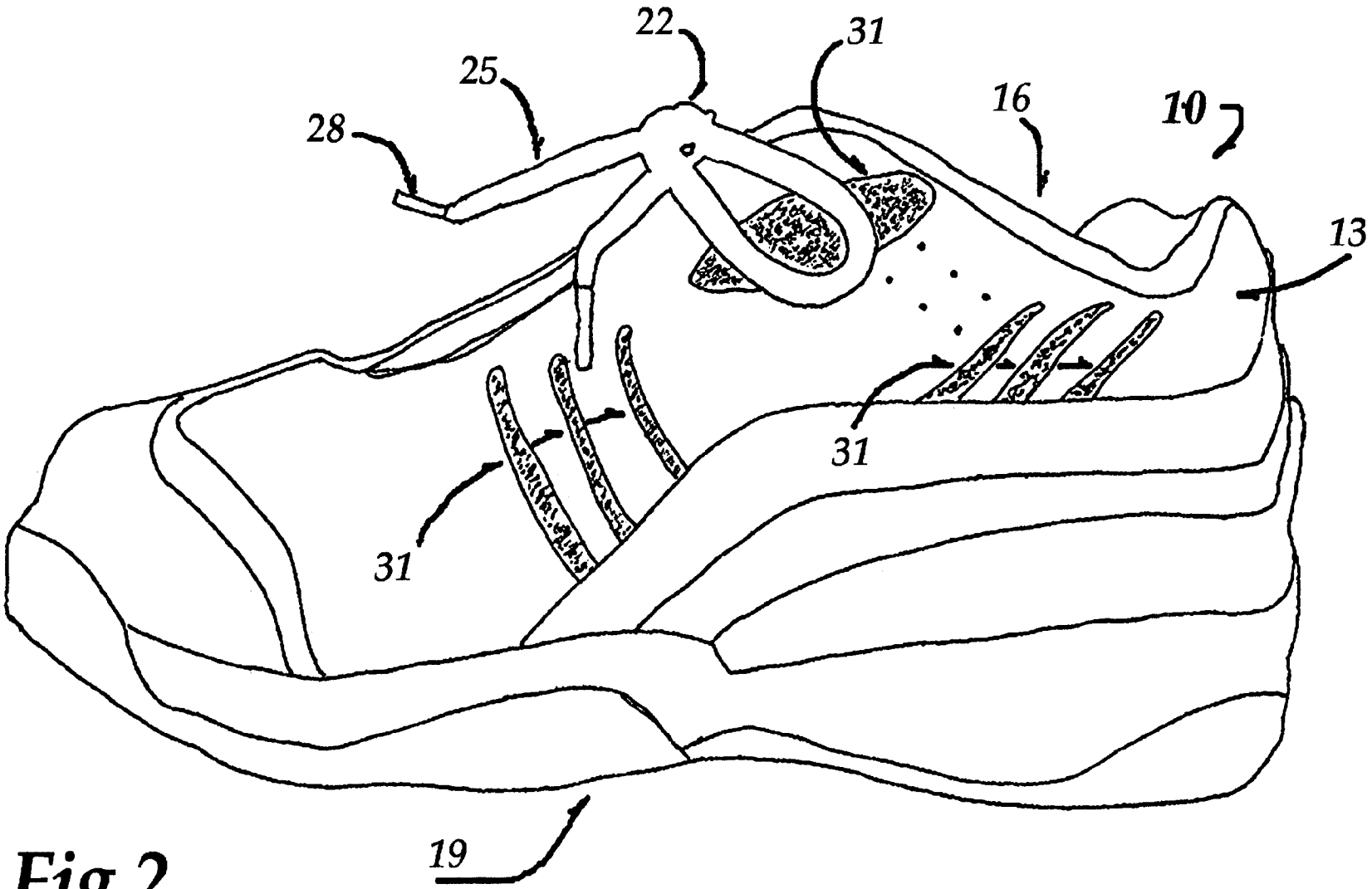
FIG. 2 is a left side elevational view of a shoe having the retaining device according to the present invention.
Figure 3:
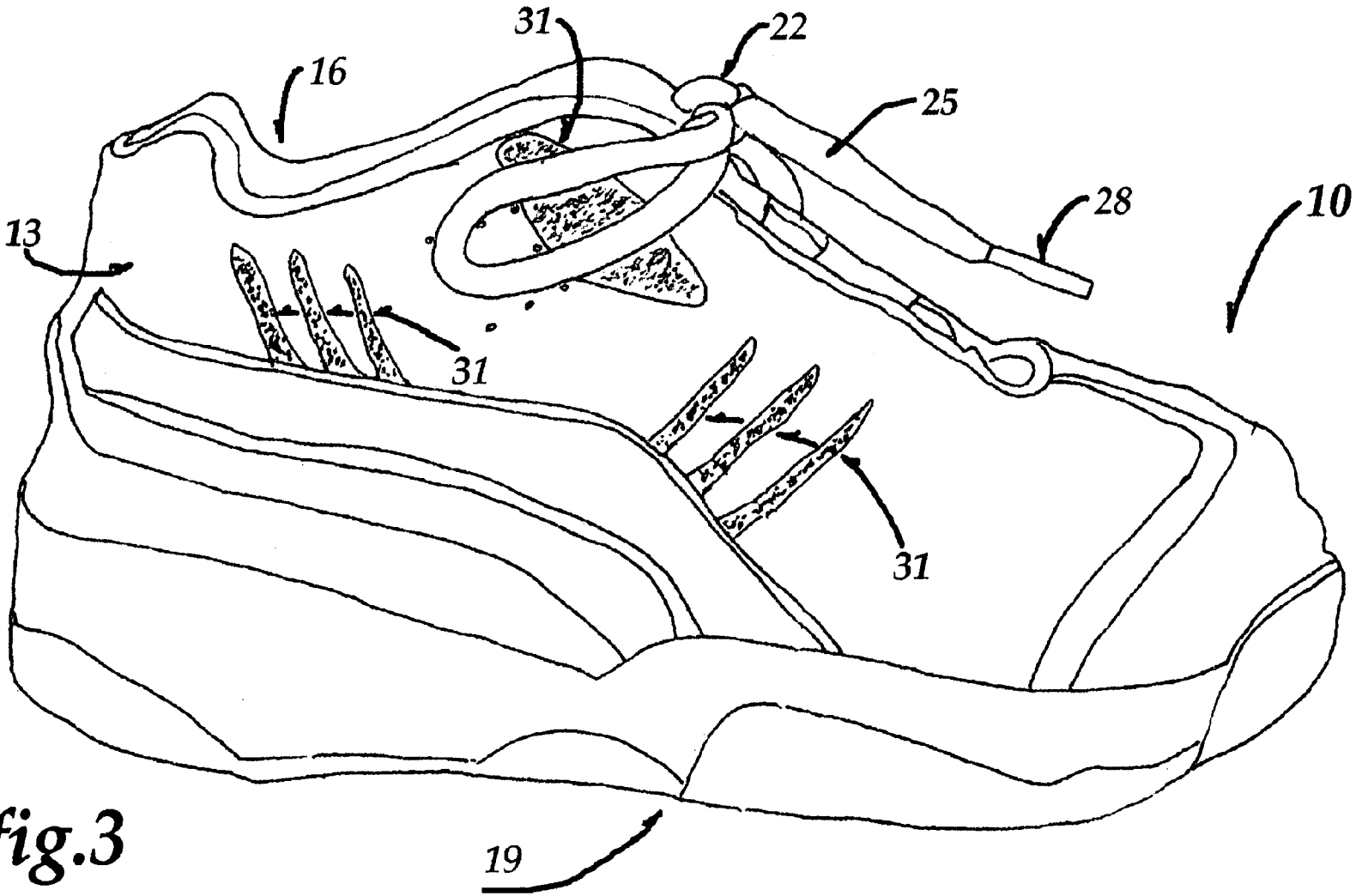
FIG. 3 is a right side elevational view of a shoe having the retaining device according to the present invention.

Referring to the figures, FIG. 1, 2, and 3 show a shoe, indicated generally as 10, having a securing device according to the present invention. The shoe 10 comprises an upper section 13 of suitable material and strength forming an enclosure 16 so as to hold the protective outsole 19 on the foot of a wearer. The enclosure 16 includes a lacing system 22 that tightens the upper section 13 around the foot. Typically, the lacing system comprises a single elongated shoelace 25 that can be tied in a releasable knot, such as a bow. Such shoelace 25 typically comprises cotton or nylon having a plastic piece on each end of the shoelace 25 called aglets 28.

According to the present invention, the shoe 10 further comprises one or more securing patches 31. The insert portion of FIG. 1 illustrate a plan view of a securing patch 31 and a side view of the securing patch 31 showing a plurality of flexible hooks on the patch 31. The securing patches 31 comprise only the hook side of a typical hook-and-loop fastener, such as provided under the brand name Velcro®. Such securing patch 31 is designed to attach to the material of the shoelace 25. The securing patch 31 may be of any size and shape to fit on the shoe 10. In a preferred embodiment, the patch 31 can be constructed into the surface of the shoe 10 at various points and locations. In an alternate embodiment, the patch 31 can be provided with a pressure sensitive adhesive on its back that will adhere to the shoe 10. The patch 31 can be used as an ornamental feature of the shoe 10, as well as a functional retaining device.

The securing patch 31 will stick to most substrates such as leather, nylon, cotton, plastic, and rubber, etc. and, because of its hook-like surface, will hold the loose ends of tied shoelaces to itself causing them to cling or attach. The securing patch 31 can be used in the construction of a variety of athletic, casual, and dress shoes for all ages and genders. In a preferred embodiment, the grade of securing patch 31 is not rough but a soft or fuzzy quality and is low lying. Uses a grade of securing patch 31 that is sleek and matches and/or exceeds the following criteria:

Adjustability & Versatility

1. Serves as the counterpart or loop-side of a hook-and-loop fastener to attach the shoelaces 25 in a fused manner to hold the shoelaces 25 to the outside of the shoe 10.

2. Accommodates different sizes and thickness of shoelaces 25 through a "one-size-fits-all" patch.

3. Appears in strips that come in a variety of diameters that are either fixed or flexible.

4. Shifts and manipulates to different positions by detaching and reattaching strips for multiple reuses.

Creativity & Appeal

1. Appeals to youth and is kid-friendly due to its lightweight, ease of use (peel and stick).

2. Alleviates the need of individuals retying shoelaces multiple times throughout the day.

3. Offers different colors, shapes, and designs for boys and girls, men and women of all ages.

4. Presents a translucent/transparent or opaque backside of the retaining fastener (i.e., the top side of the hook side) giving a creative component to express individuality with the capacity on which to write or draw.

Safety & Security

1. Provides a shoelace constraint and training tool for youth.

2. Secures the laces to the surface of shoes thereby restricting and/or securely holding tied shoelaces in place.

3. Adheres to shoelaces made of cotton, nylon, and the like, as well as other such materials with similar properties.

4. Offers a pliable shoelace movement inhibitor that serves as a safety device.

Figure 4A:
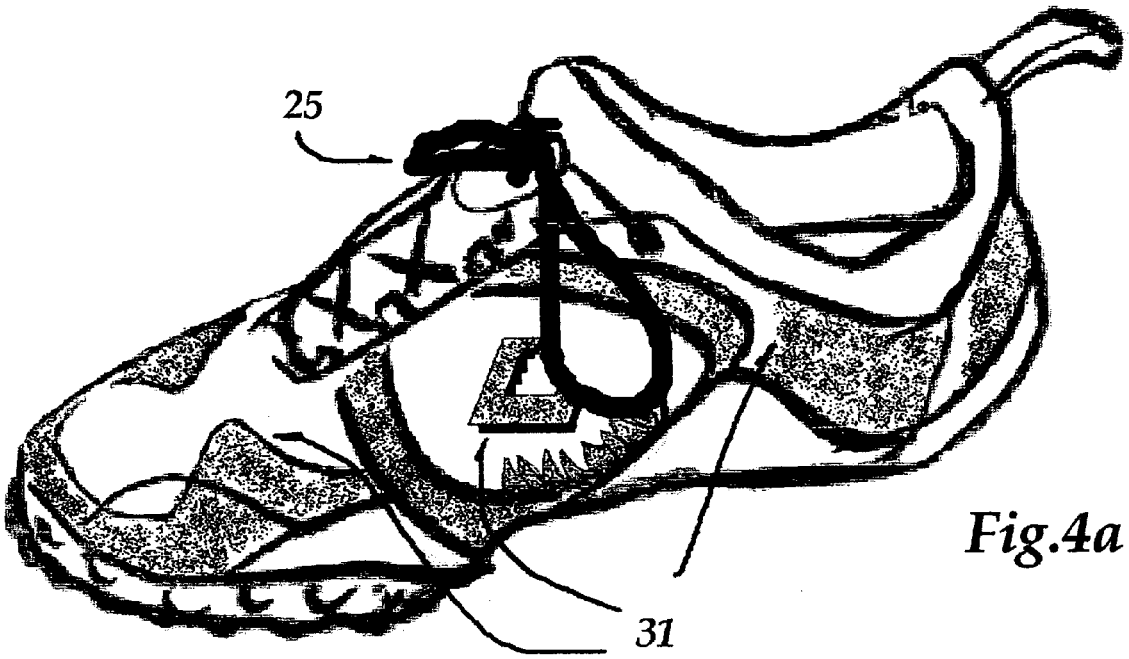
FIGS. 4*a* and 4*b* are left and right perspective views of a shoe employing the retaining device according to one embodiment of the present invention.
Figure 4B:
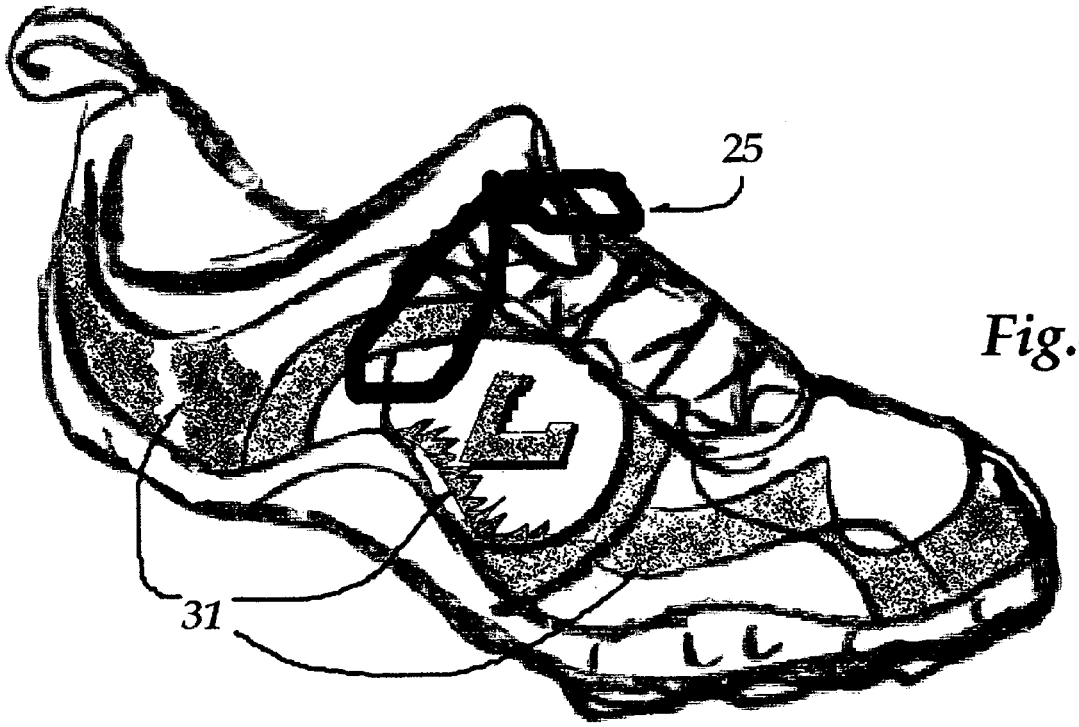

In use, the retaining device of the present invention is used by pressing the bows of a tied shoelace against one or more of the securing patches 31, as shown in FIGS. 4*a* and 4*b*. First, the shoelace 25 is tied in a conventional manner, and then the loops of the bow are attached to the securing patch 31.

Figure 5A:
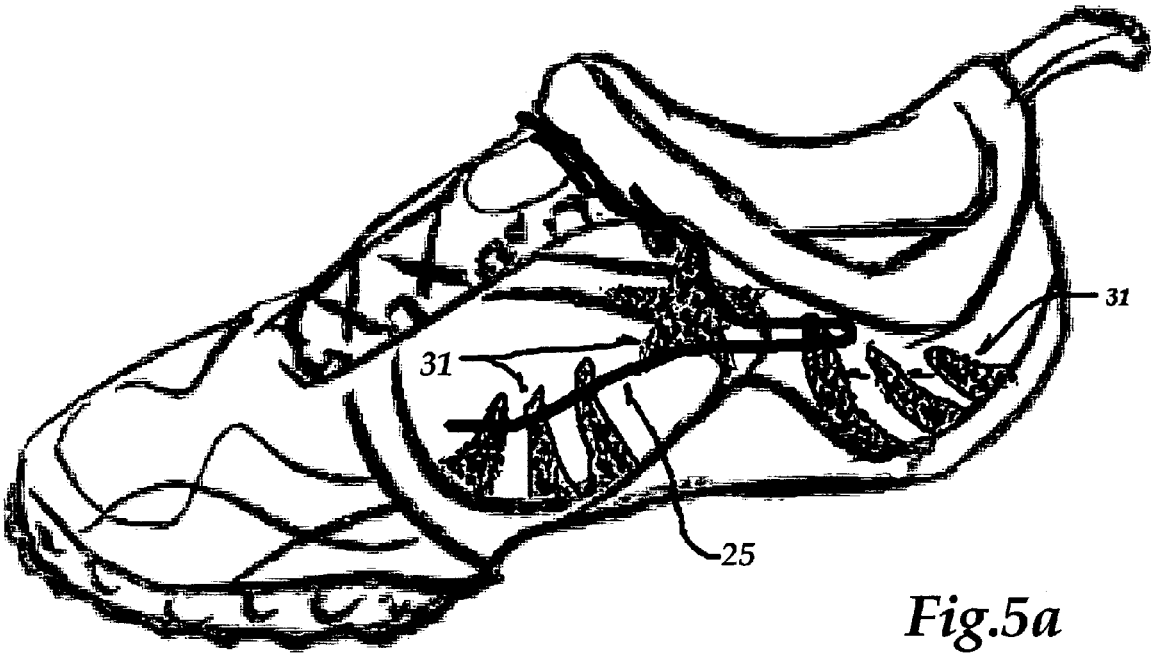
FIGS. 5*a* and 5*b* are left and right perspective views of a shoe employing the retaining device according to another embodiment of the present invention.
Figure 5B:
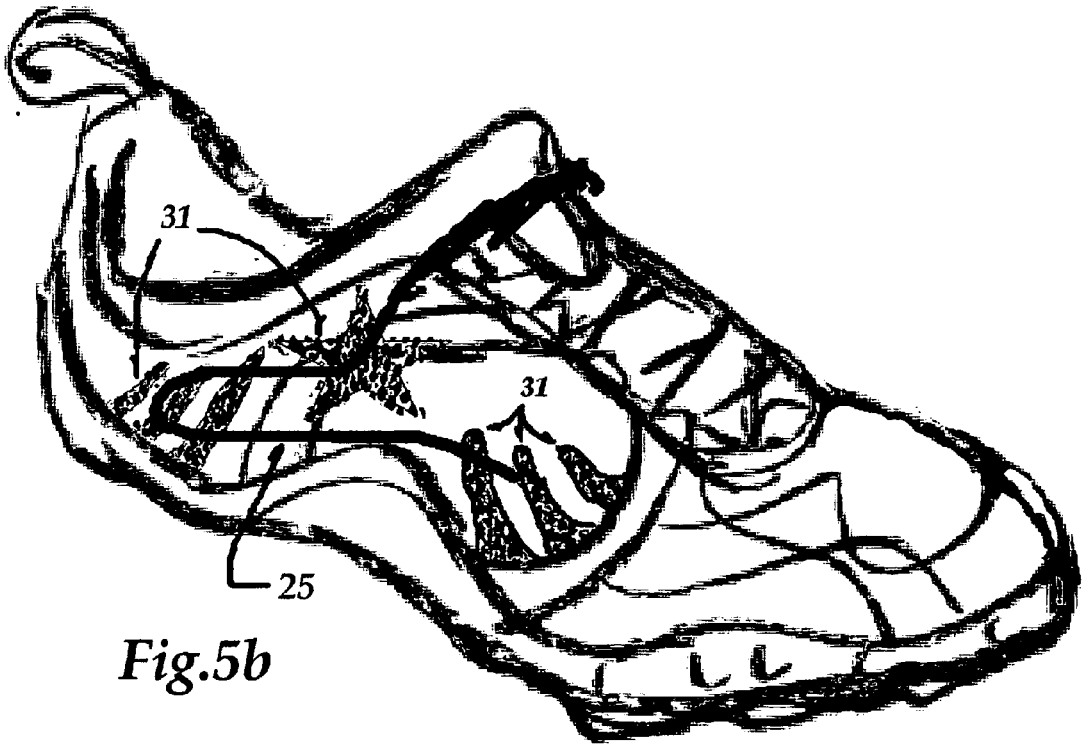

Referring to FIGS. 5*a* and 5*b*, the retaining device of the present invention also permits the shoelace 25 to be held without the shoelace being tied. First, the shoelace may be tightened by a simple overhand twist, and then the remaining length of the shoelace 25 is attached to the securing patch 31. The securing patch prevents the free ends of the shoelace 25 from being caught underfoot or on other objects causing a tripping hazard.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A shoelace holder, comprising:

at least one patch;

said at least one patch consisting of only a hook portion of a hook and loop type fastener;

said at least one patch not comprising a loop portion of said hook and loop type fastener;

said at least one patch having a pressure sensitive adhesive on the back thereof;

said pressure sensitive adhesive being releasably adhered to a shoe;

said hook portion of said at least one patch being directly attaching to a lace portion of a shoelace, with no involvement of a mating portion of the fastener;

said at least one patch displaying a decoration;

said at least one patch being shiftable and manipulatable to different positions by detaching and reattaching; and said at least one patch comprising a variety of shapes and designs to fit on the shoe.

2. A method of securing shoelace, comprising the steps of:

providing at least one patch consisting of only a hook portion of a hook and loop type fastener and a pressure sensitive adhesive surface;

releasably adhering said pressure sensitive adhesive surface to a shoe;

tying said shoelace in a releaseable knot that comprises a bow;

pressing loops of said bow directly to said hook portion of said at least one patch, with no involvement of a mating portion of the fastener;

holding said shoelace to said shoe through said at last one patch to prevent a tripping hazard;

shifting and manipulating said at least one patch to different positions by detaching and reattaching; and peeling off said at least one patch from said shoe, and replacing said at least one patch with another patch with a different decoration design.

3. A method for securing shoelace, comprising the steps of:

providing at least one patch consisting of only a hook portion of a hook and loop type fastener and a pressure sensitive adhesive surface;

releasably adhering said pressure sensitive adhesive surface to a shoe;

tightening a shoelace without tying a knot;

pressing a remaining length of said shoelace directly to said hook portion of said at least one patch, with no involvement of a mating portion of the fastener;

holding said shoelace to said shoe through said at last one patch to prevent a tripping hazard;

shifting and manipulating said at least one patch to different positions by detaching and reattaching; and peeling off said at least one patch from said shoe and replacing said at least one patch with another patch with a different decoration design.

* * * * *